US009693627B2

(12) United States Patent
Chen et al.

(10) Patent No.: US 9,693,627 B2
(45) Date of Patent: Jul. 4, 2017

(54) QUICK-RELEASE MECHANISM FOR DRAWER SLIDE PARTS

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Fang-Cheng Su, Kaohsiung (TW); Hsiu-Chiang Liang, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/202,815

(22) Filed: Jul. 6, 2016

(65) Prior Publication Data

US 2017/0135476 A1 May 18, 2017

(30) Foreign Application Priority Data

Nov. 12, 2015 (TW) ..... 104137458 A

(51) Int. Cl.
*A47B 88/04* (2006.01)
*A47B 88/08* (2006.01)

(52) U.S. Cl.
CPC ..... *A47B 88/0422* (2013.01); *A47B 88/08* (2013.01); *A47B 2088/0429* (2013.01); *A47B 2088/0437* (2013.01)

(58) Field of Classification Search
CPC .... A47B 2088/4272; A47B 2088/4274; A47B 2088/0429; A47B 2088/4276; A47B 2088/4278; A47B 2088/0437; A47B 88/407; A47B 88/0407; A47B 88/423; A47B 88/0418; A47B 88/427; A47B 88/0422; A47B 2210/09; A47B 2210/091
See application file for complete search history.

(56) References Cited

U.S. PATENT DOCUMENTS 4,653,821 A * 3/1987 Faust ..... A47B 88/487 248/222.13
6,454,371 B1 * 9/2002 Muterthies ..... A47B 88/427 312/263
7,549,712 B2 * 6/2009 Booker ..... F16F 9/0218 312/333
7,695,080 B2 4/2010 Chen et al.
(Continued)

FOREIGN PATENT DOCUMENTS

AT WO2015120493 A1 * 8/2015 ..... A47B 88/04
DE 202013004939 U1 * 9/2014 ..... A47B 88/427
DE WO2015144769 A1 * 10/2015 ..... A47B 88/04

*Primary Examiner* — Andrew Roersma
(74) *Attorney, Agent, or Firm* — Rosenberg, Klein & Lee

(57) ABSTRACT

A quick-release mechanism for drawer slide parts includes a first rail, a second rail, a drawer frame member, and an engaging member. The second rail can be displaced with respect to the first rail and includes an engaging portion. The drawer frame member includes a carrier which is mounted on the second rail. The engaging member is mounted on the drawer frame member. The drawer frame member is releasably mounted on the second rail via the engaging member engaged with the engaging portion of the second rail.

9 Claims, 8 Drawing Sheets

(56) References Cited

U.S. PATENT DOCUMENTS

| | | | | |
|---|---|---|---|---|
| 8,056,994 | B2 | 11/2011 | Chen et al. | |
| 8,336,973 | B2 * | 12/2012 | Berger | A47B 88/427 312/334.4 |
| 8,696,078 | B2 * | 4/2014 | Gasser | A47B 88/16 312/334.5 |
| 8,807,672 | B2 | 8/2014 | Gasser | |
| 8,979,223 | B2 * | 3/2015 | Huang | A47B 88/0422 312/334.4 |
| 2011/0068670 | A1 | 3/2011 | Ritter | |

* cited by examiner

QUICK-RELEASE MECHANISM FOR DRAWER SLIDE PARTS

FIELD OF THE INVENTION

The present invention relates to a quick-release mechanism for drawer slide parts and more particularly to a device which enables a drawer frame member to be mounted to and detached from a slide assembly rapidly.

BACKGROUND OF THE INVENTION

Conventionally, a drawer is mounted by locking it to the slides of a pair of slide assemblies using a fixing means such as screws, so the drawer can be pulled out of and pushed back into a cabinet by extending and retracting the slide assemblies.

U.S. Pat. No. 8,807,672 B2 discloses a drawer pull-out guide including a locking device. The locking device is mounted on a rail of a slide assembly and serves to mount a drawer to the rail in a tool-free manner. When it is desired to detach the drawer from the rail for cleaning or other purposes, this can be done after the locking device is released. The disclosure of the US patent is incorporated herein by reference. While the locking device is configured to mount the drawer to, and allow its detachment from, the slide assembly, the detaching operation requires the use of both hands: the operator must release the locking device with one hand and pull out the drawer with the other. Since a drawer is typically mounted with a slide assembly on each of its left and right sides, it is impossible for the operator to detach the locking devices on both sides at the same time. The design of the drawer pull-out guide, therefore, causes inconvenience in use.

SUMMARY OF THE INVENTION

The present invention relates to a quick-release mechanism for drawer slide parts, wherein an engaging member is mounted on a drawer frame member of a drawer and is detachably engaged with a slide of a slide assembly so that the drawer frame member can be mounted and detached rapidly.

According to one aspect of the present invention, a quick-release mechanism for drawer slide parts includes a first rail, a second rail, a drawer frame member, and an engaging member. The second rail can be displaced with respect to the first rail and has an engaging portion. The drawer frame member includes a carrier mounted on the second rail. The engaging member is mounted on the drawer frame member. Once the drawer frame member is mounted on the second rail, the engaging member is engaged with the engaging portion to fix the second rail and the drawer frame member to each other.

Preferably, the carrier has a front portion, and the engaging member is mounted at the front portion of the carrier.

Preferably, the carrier has a rear portion opposite the front portion, the rear portion of the carrier has a pressing portion, the second rail has a stop portion, and the pressing portion is configured to be pressed against and stopped by the stop portion.

Preferably, the engaging member is fixed to the carrier by a fixing means, the second rail has an end portion provided with a recess, and the fixing means is fitted in the recess.

Preferably, the engaging portion includes a plurality of first engaging blocks; the engaging member has a base mounted on the carrier, an elastic arm extending from the base, and a plurality of second engaging blocks on the elastic arm; and one of the first engaging blocks interlocks with one of the second engaging blocks to fix the second rail and the drawer frame member to each other.

Preferably, each of the first engaging blocks has a front end provided with a first inclined surface, each of the second engaging blocks has a front end provided with a second inclined surface, and the second inclined surface of one of the second engaging blocks moves past the first inclined surface of one of the first engaging blocks in order for the one of the first engaging blocks to interlock with the one of the second engaging blocks.

Preferably, the elastic arm has an operating member which can be operated to disengage the interlocked first and second engaging blocks.

According to another aspect of the present invention, a quick-release mechanism for drawer slide parts includes a rail, a drawer frame member, and an engaging member. The rail includes an engaging portion, and the drawer frame member includes a carrier mounted on the rail. The engaging member is mounted on the drawer frame member. Once the drawer frame member is mounted on the rail, the engaging member is engaged with the engaging portion to fix the rail and the drawer frame member to each other.

DETAILED DESCRIPTION OF THE INVENTION

Figure 1:
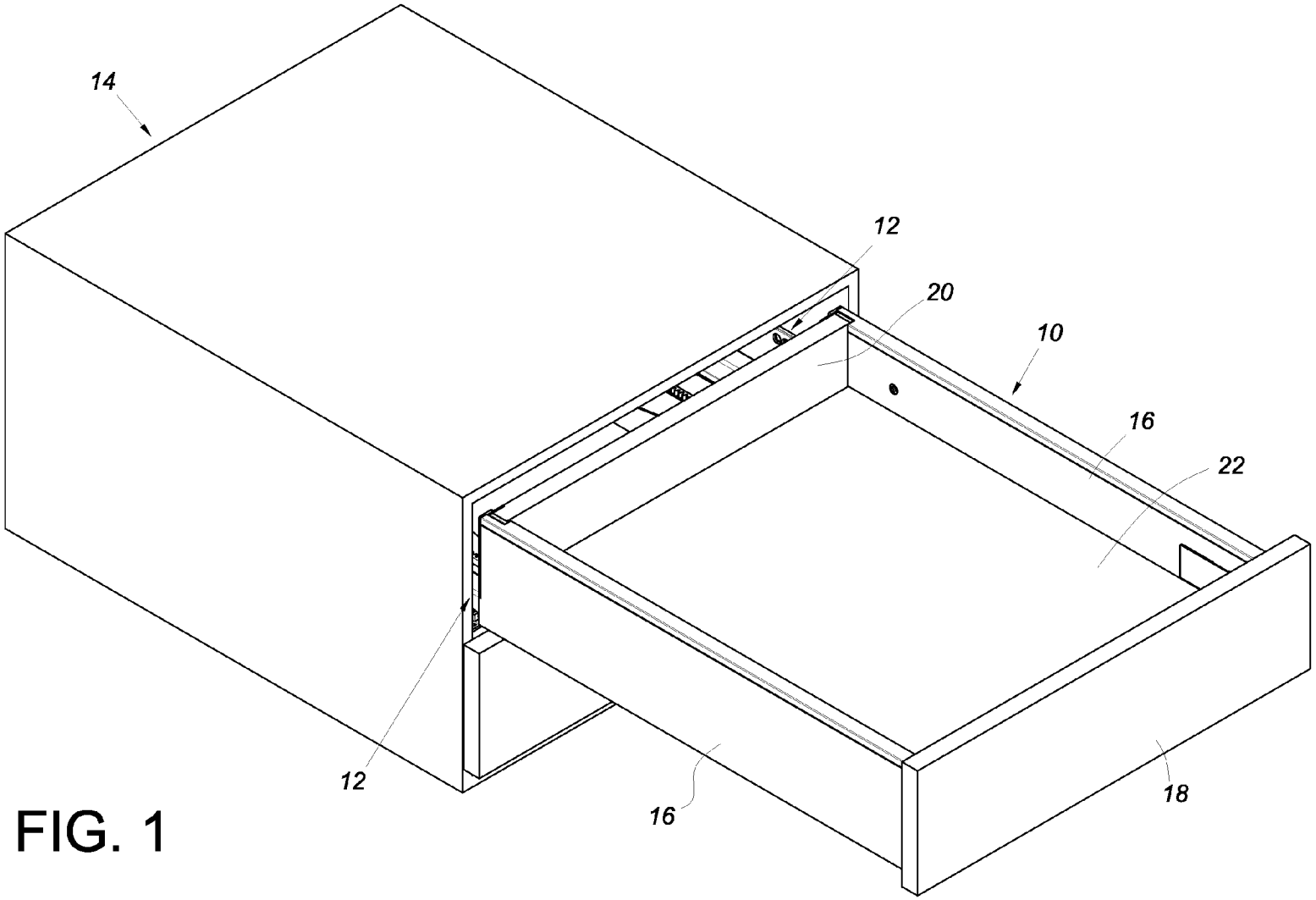
FIG. 1 is a perspective view showing how the drawer in an embodiment of the present invention is mounted to a cabinet via a pair of slide assemblies.

Referring to FIG. 1, a drawer 10 is mounted to a cabinet 14 via a pair of slide assemblies 12. The slide assemblies 12 allow the drawer 10 to be pulled out of and pushed back into the cabinet 14. The drawer 10 includes a pair of drawer frame members 16, a front panel 18, a rear panel 20, and a bottom panel 22. The drawer frame members 16 are mounted on the slide assemblies 12 respectively to form a quick-release mechanism for drawer slide parts.

Figure 2:
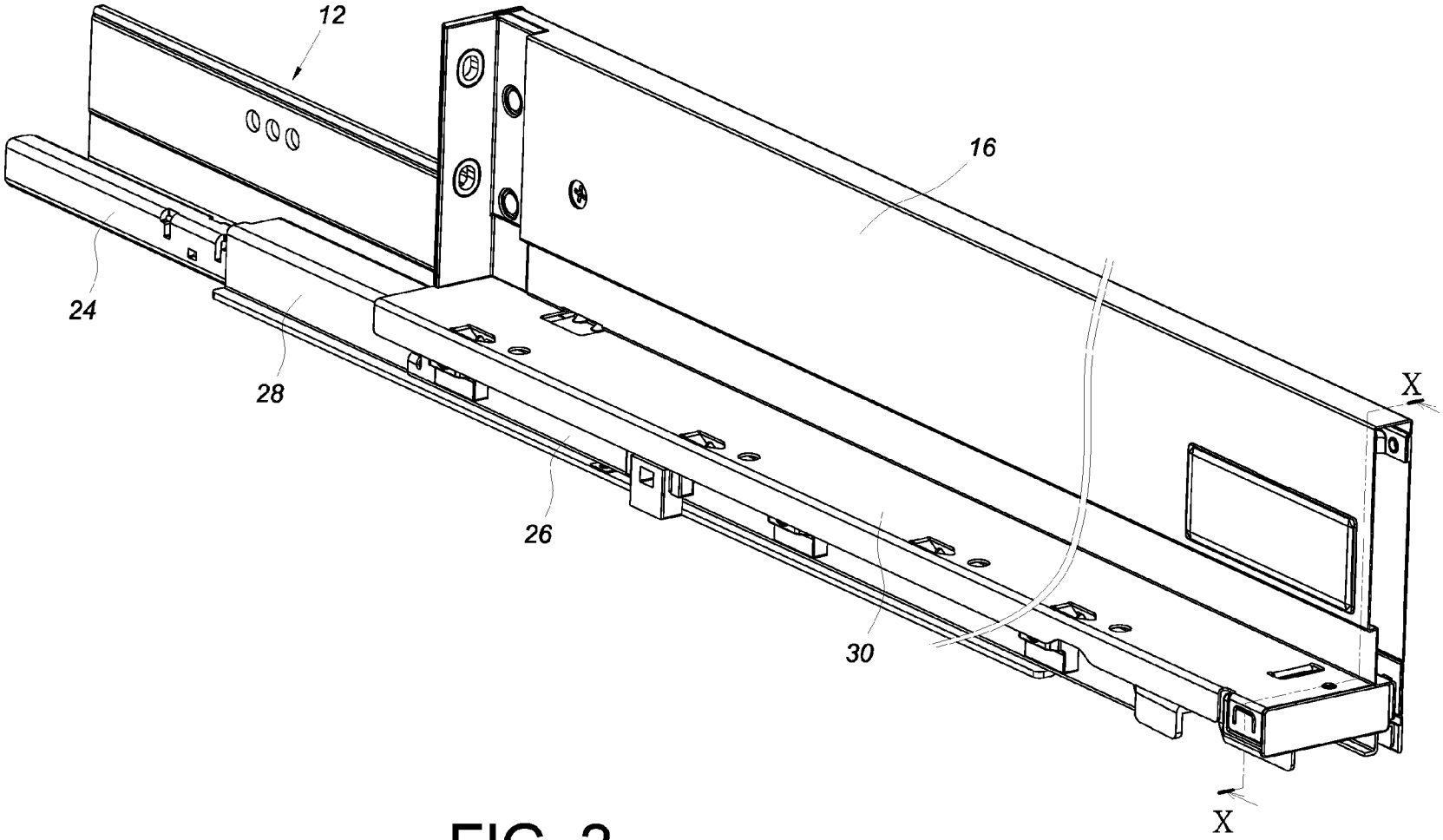
FIG. 2 is a perspective view showing how a drawer frame member of the drawer in FIG. 1 is mounted to the corresponding slide assembly.

FIG. 2 shows one of the drawer frame members 16 mounted on the corresponding slide assembly 12. As shown in the drawing, the slide assembly 12 includes a first rail 24 and a second rail 26 which can be displaced with respect to the first rail 24. The slide assembly 12 further includes a third rail 28 movably connected between the first rail 24 and the second rail 26 in order to increase the distance by which the second rail 26 can be pulled out with respect to the first rail 24. The drawer frame member 16 is mounted on the second rail 26 via a carrier 30.

Figure 3:
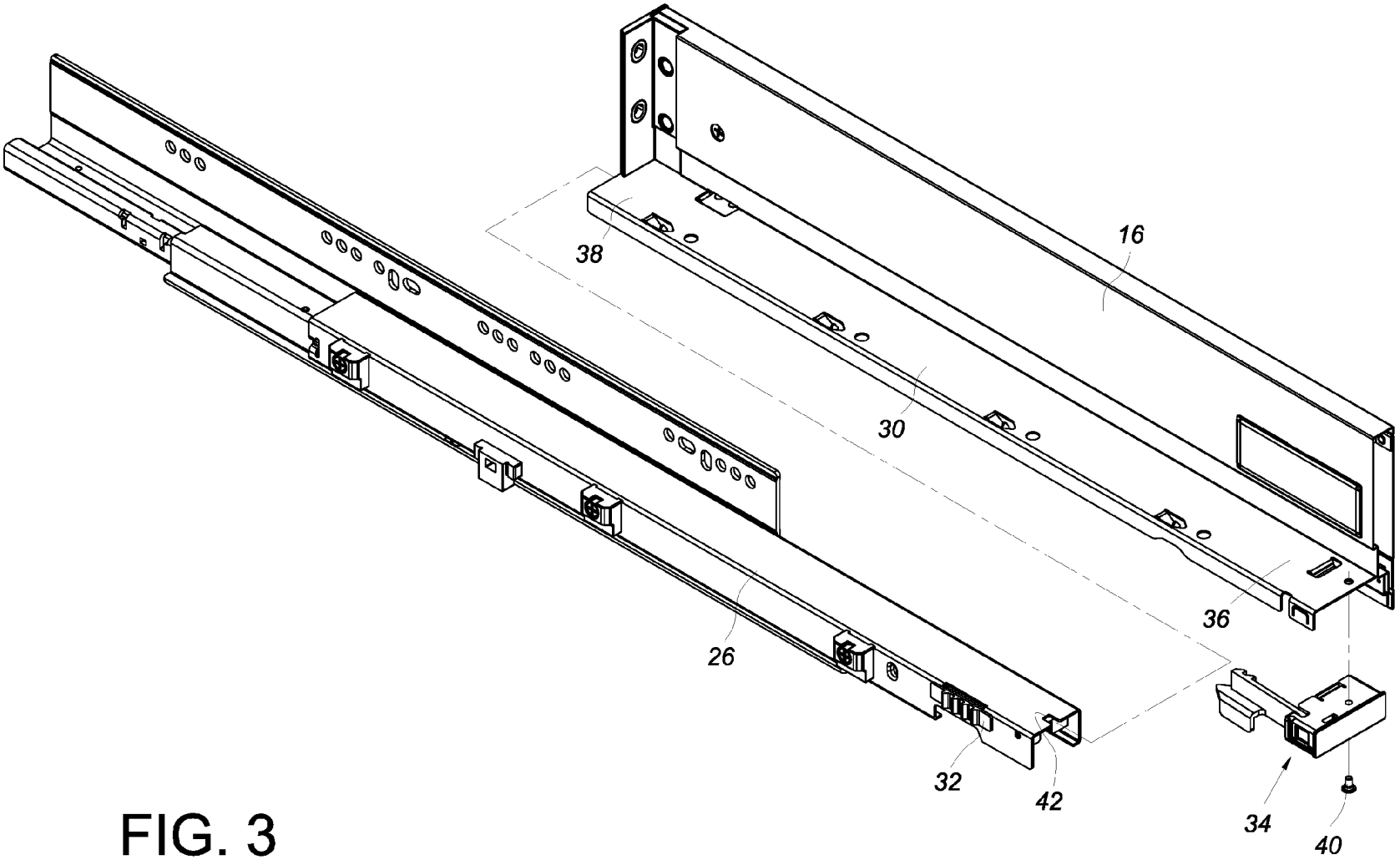
FIG. 3 is an exploded perspective view showing how the drawer frame member in FIG. 2 is mounted to the second rail of the slide assembly via an engaging member.
Figure 4:
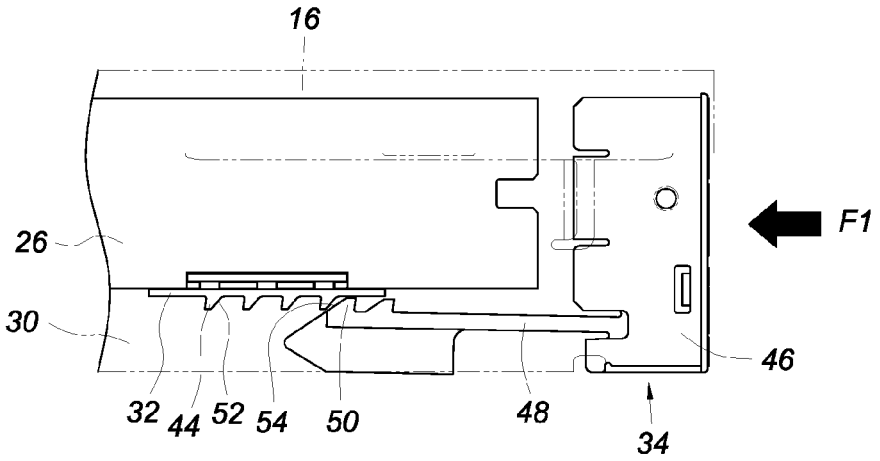
FIG. 4 is a plan view showing how the engaging member in FIG. 3 corresponds to an engaging portion of the second rail while the drawer frame member is being mounted to the second rail.
Figure 5:
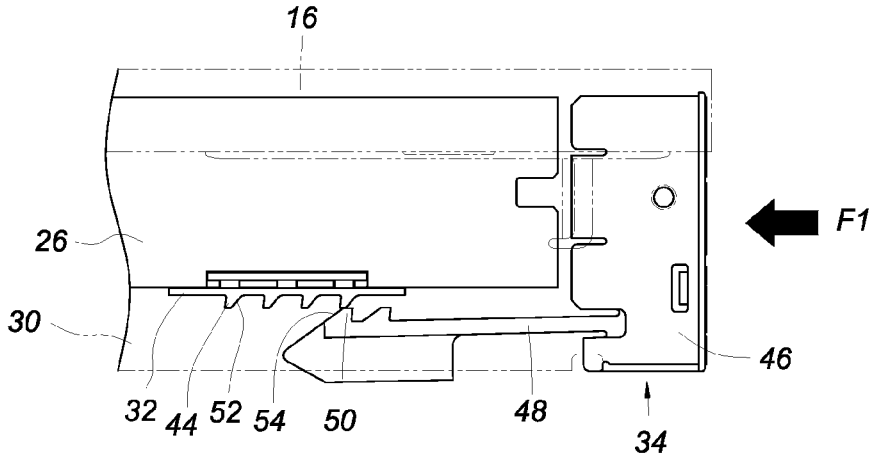
FIG. 5 is a plan view showing how the second inclined surface of the leading second engaging block of the engaging member in FIG. 4 moves past the first inclined surface of the first-encountered first engaging block of the engaging portion while the drawer frame member is being mounted to the second rail.

As shown in FIG. 3, the second rail 26 includes an engaging portion 32. In practice, the engaging portion 32 can be either a component attached to the second rail 26 or integrally formed with the second rail 26. Additionally, an engaging member 34 is mounted on the drawer frame member 16 and corresponds to the engaging portion 32. More specifically, the carrier 30 of the drawer frame member 16 has a front portion 36 and a rear portion 38 opposite the front portion 36, and the engaging member 34 is mounted at the front portion 36 of the carrier 30. The engaging member 34 is fixed to the front portion 36 of the carrier 30 by a fixing means 40 such as a screw. The fixing means 40 corresponds to a recess 42 in an end portion of the second rail 26.

As shown in FIG. 4A to FIG. 6, the engaging portion 32 includes a plurality of first engaging blocks 44, and the engaging member 34 has a base 46 mounted on the carrier 30, an elastic arm 48 extending from the base 46, and a plurality of second engaging blocks 50 on the elastic arm 48. Each first engaging block 44 has a front end provided with a first inclined surface 52 while each second engaging block 50 has a front end provided with a second inclined surface 54. To mount the carrier 30 of the drawer frame member 16 to the second rail 26, a portion of the carrier 30 is put astride the second rail 26, and an external force F1 is applied to the carrier 30 to move the carrier 30 along the second rail 26 toward a mounting position. During the process, the engaging member 34 approaches the engaging portion 32 of the second rail 26 until the leading second engaging block 50 of the engaging member 34 is pressed against the first-encountered first engaging block 44 of the engaging portion 32. As application of the external force F1 continues, the second inclined surface 54 of the leading second engaging block 50 of the engaging member 34 pushes the first inclined surface 52 of the first-encountered first engaging block 44 such that the elastic arm 48 is forced aside, allowing the leading second engaging block 50 to move past and interlock with the first-encountered first engaging block 44. Consequently, the second rail 26 and the drawer frame member 16 are fixed to each other.

Figure 8:
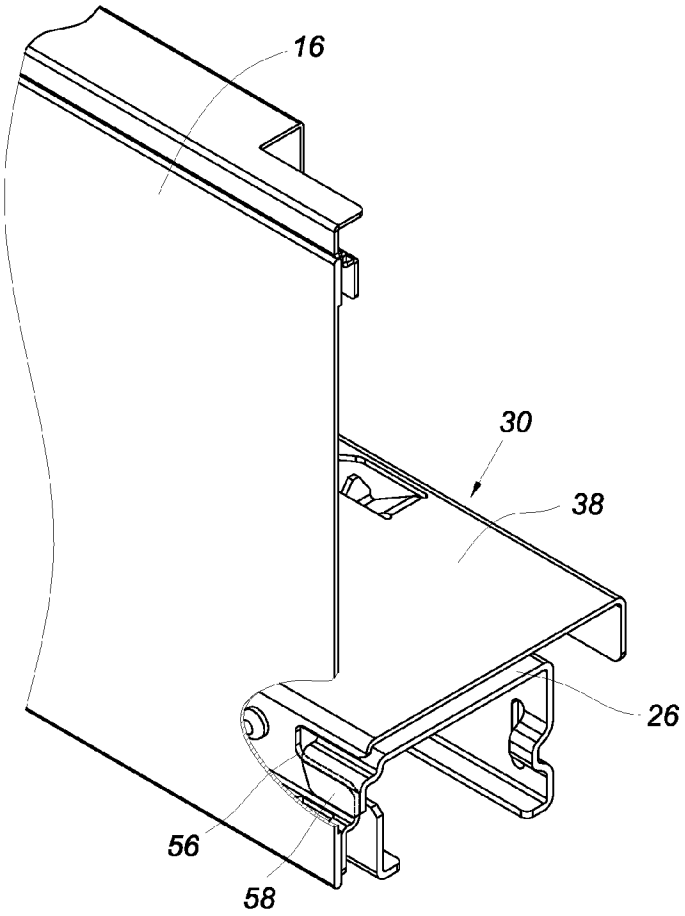
FIG. 8 is a perspective view showing the pressing portion of the carrier in FIG. 7 pressed against the stop portion of the second rail.
Figure 7:
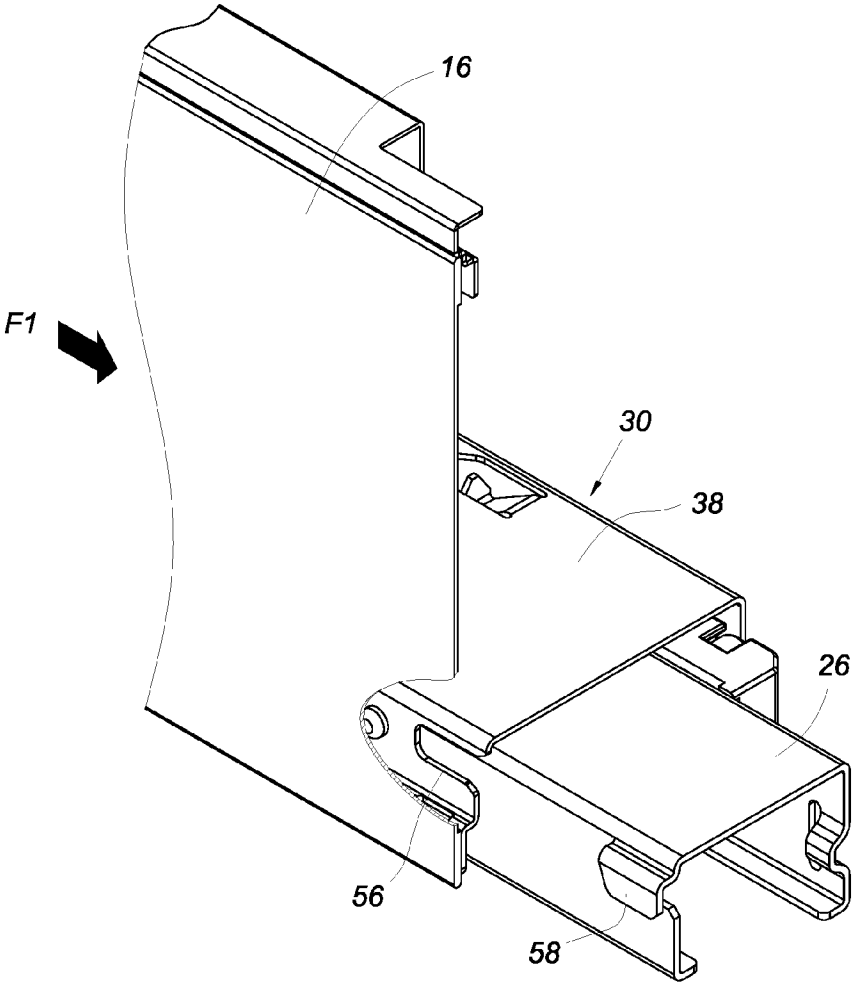
FIG. 7 is a perspective view showing that the carrier in FIG. 2 has a pressing portion corresponding to a stop portion of the second rail.
Figure 9:
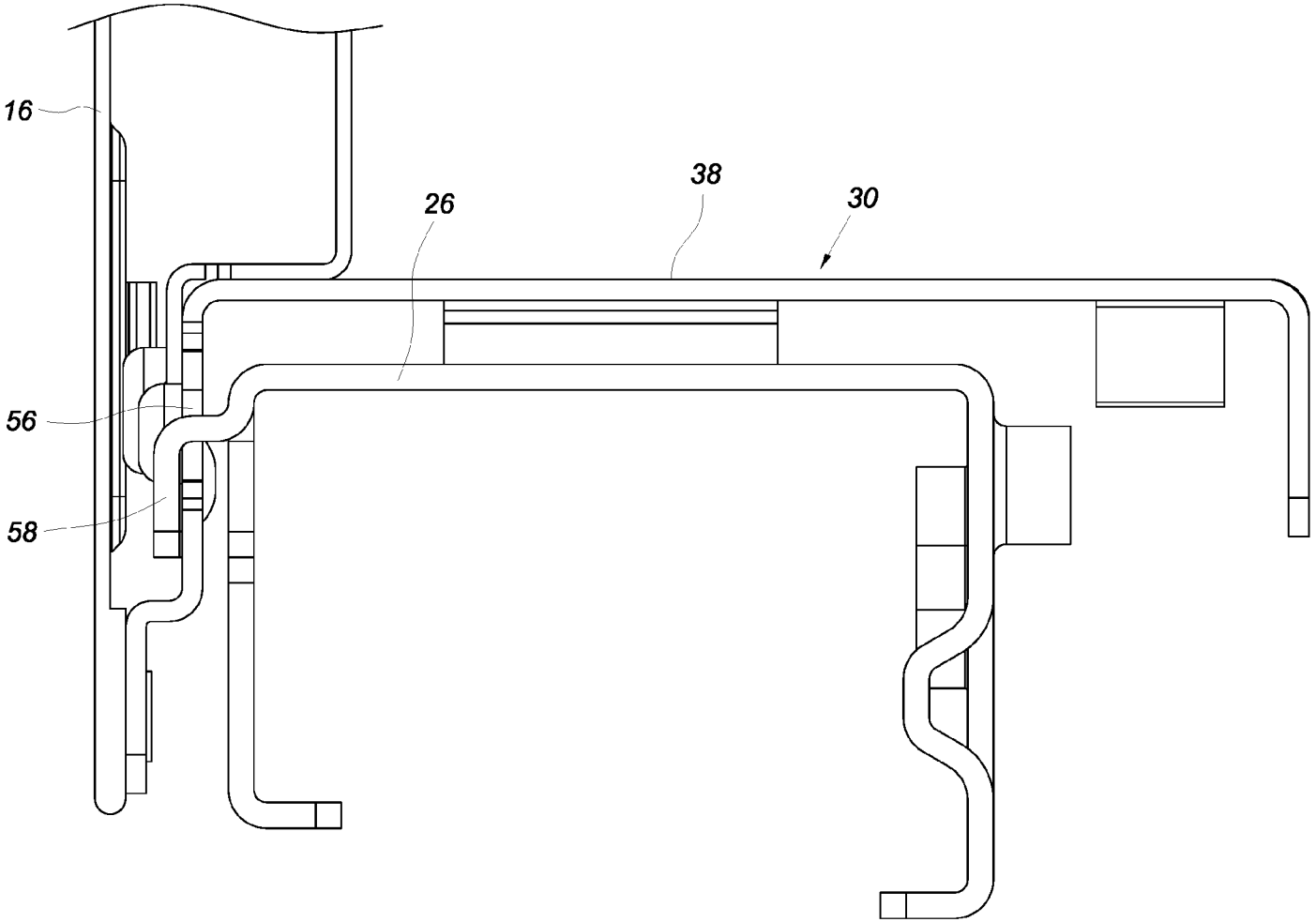
FIG. 9 is a plan view showing how the pressing portion of the carrier of the drawer frame member in FIG. 7 is pressed against the stop portion of the second rail.

Referring to FIG. 7 to FIG. 9, the rear portion 38 of the carrier 30 has a pressing portion 56, the second rail 26 has a stop portion 58, and the pressing portion 56 corresponds to the stop portion 58. When the carrier 30 subjected to the external force F1 moved along the second rail 26 to the mounting position, the pressing portion 56 is pressed against and stopped by the stop portion 58. More specifically, the pressing portion 56 is a groove, and the stop portion 58 is a protruding stop plate. Once the carrier 30 moves along the second rail 26 to the mounting position, the stop plate is fitted in the groove and thus fixed in place, as shown in FIG. 8 and FIG. 9. After the drawer frame member 16 is mounted to the second rail 26 via the carrier 30, both the front portion 36 and the rear portion 38 of the carrier 30 are securely fixed to the second rail 26.

Figure 6:
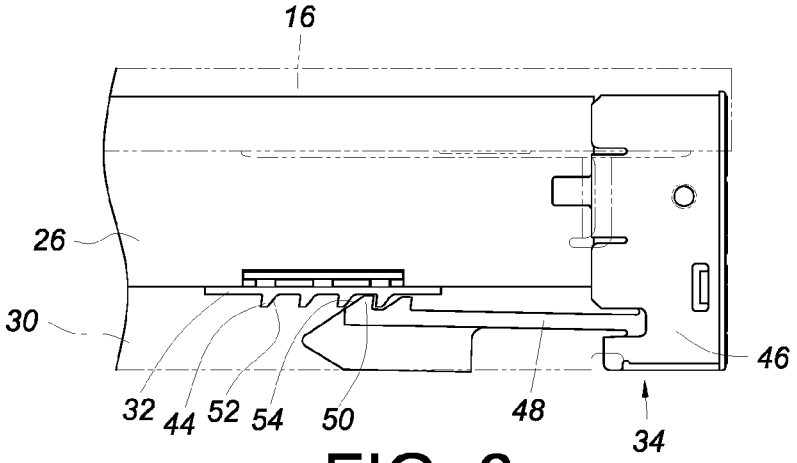
FIG. 6 is a plan view showing how the leading second engaging block of the engaging member in FIG. 5 interlocks with the first-encountered first engaging block of the engaging portion to fix the second rail and the drawer frame member to each other while the drawer frame member is being mounted to the second rail.
Figure 10:
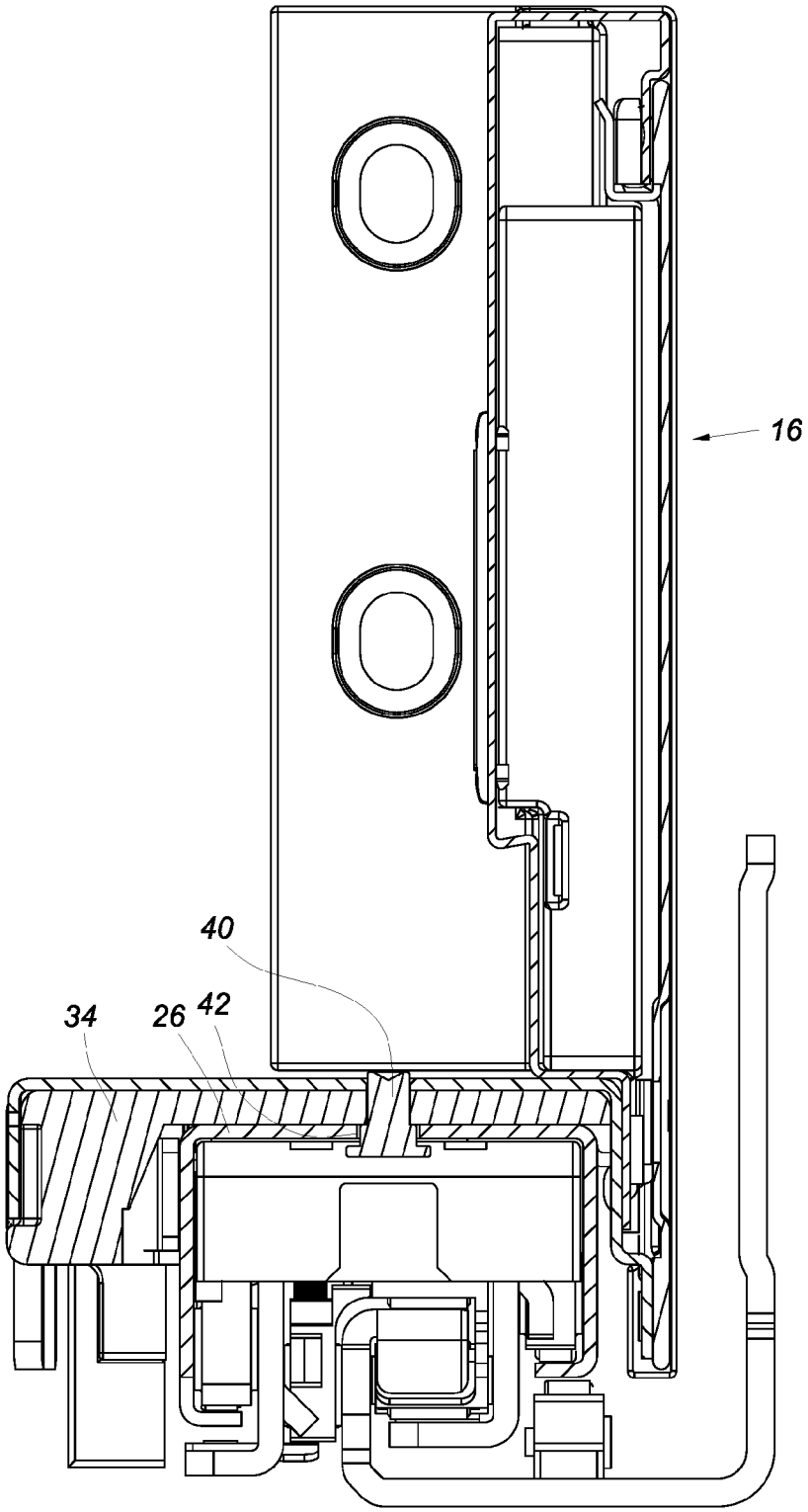
FIG. 10 is a sectional view of FIG. 2, showing how the engaging member is locked to the carrier of the drawer frame member by a screw and how the screw is fitted into a recess of the second rail.

Referring to FIG. 10, when the drawer frame member 16 is mounted on the second rail 26, the fixing means 40 happens to fit in the recess 42 of the second rail 26 and is restrained in the recess 42, thereby preventing lateral vibrations caused by pulling or pushing the drawer 10 (see FIG. 1) from disengaging the interlocked first and second engaging blocks 44 and 50 (see FIG. 6). This technical feature lends enhanced stability to the mechanism of the present invention.

Figure 11:
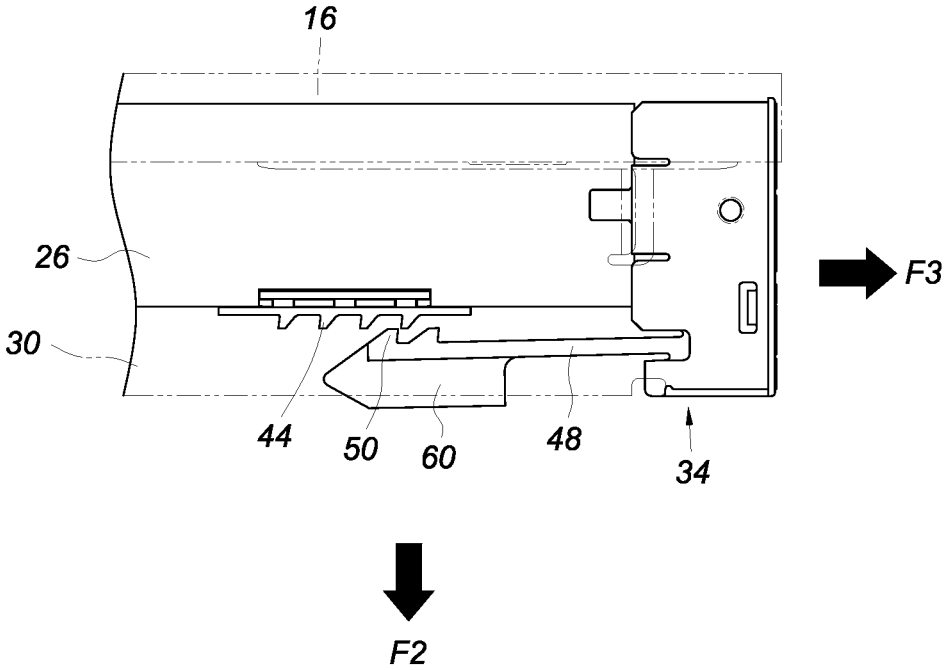
FIG. 11 schematically shows how an operating member is operated to disengage the engaging member in FIG. 6 from the engaging portion of the second rail.

In addition, referring to FIG. 11, the elastic arm 48 of the engaging member 34 has an operating member 60. When the drawer 10 (see FIG. 1) needs to be pulled out in order to be cleaned or the like, the user can apply a lateral external force F2 to the operating member 60 singlehandedly, or more particularly with four fingers (i.e., excluding the thumb), to pull the elastic arm 48 open, thus separating the interlocked first and second engaging blocks 44 and 50. Further, holding the drawer frame member 16 in the palm of the same hand, the user applies an external force F3 to the drawer frame member 16 in a direction facing away from the mounting position, in order to move the carrier 30 along the second rail 26 toward a pulled-out position, thereby separating the drawer frame member 16 from the second rail 26.

The singlehanded detaching operation described above is made possible by the fact that the engaging member 34 is mounted on the drawer frame member 16. The present invention, therefore, provides convenience of operation by allowing the user to detach the drawer 10 (see FIG. 1) from the left and right slide assemblies 12 with both hands simultaneously.

While the present invention has been disclosed by way of the foregoing preferred embodiment, the embodiment is not intended to be restrictive of the scope of the invention. The scope of patent protection sought by the applicant is defined by the appended claims.

What is claimed is:

1. A quick-release mechanism for drawer slide parts, comprising:

a first rail;

a second rail displaceable with respect to the first rail, the second rail includes an engaging portion and an end portion having a recess;

a drawer frame member comprising a carrier mounted on the second rail; and an engaging member fixed to the carrier by a fixing means, the fixing means being fitted in the recess;

wherein once the drawer frame member is mounted on the second rail, the engaging member is engaged with the engaging portion to fix the second rail and the drawer frame member to each other.

2. The quick-release mechanism for drawer slide parts of claim 1, wherein the carrier has a front portion, and the engaging member is mounted at the front portion of the carrier.

3. The quick-release mechanism for drawer slide parts of claim 2, wherein the carrier has a rear portion opposite the front portion, the rear portion of the carrier has a pressing portion, the second rail has a stop portion, and the pressing portion is configured to be pressed against and stopped by the stop portion.

4. The quick-release mechanism for drawer slide parts of claim 1, wherein the engaging portion includes a plurality of first engaging blocks; the engaging member has a base mounted on the carrier, an elastic arm extending from the base, and a plurality of second engaging blocks on the elastic arm; and one of the first engaging blocks interlocks with one of the second engaging blocks to fix the second railand the drawer frame member to each other.

5. The quick-release mechanism for drawer slide parts of claim 4, wherein each said first engaging block has a front end provided with a first inclined surface, each said second engaging block has a front end provided with a second inclined surface, and the second inclined surface of the one of the second engaging blocks moves past the first inclined surface of the one of the first engaging blocks in order for the one of the first engaging blocks to interlock with the one of the second engaging blocks.

6. The quick-release mechanism for drawer slide parts of claim 4, wherein the elastic arm has an operating member operable to disengage the one of the first engaging blocks from the one of the second engaging blocks.

7. A quick-release mechanism for drawer slide parts, comprising:

a first rail;

a second rail displaceable with respect to the first rail, the second rail comprising an engaging portion and a stop portion, the engaging portion including a plurality of first engaging blocks, the second rail further including an end portion provided with a recess;

a drawer frame member mounted on the second rail via a carrier, the carrier having a front portion and a rear portion, the rear portion of the carrier having a pressing portion; and an engaging member comprising a base mounted on the carrier and affixed thereto by a fixing means, an elastic arm extending from the base, and a plurality of second engaging blocks on the elastic arm, the fixing means being fitted in the recess;

wherein once the drawer frame member is mounted on the second rail, one of the first engaging blocks interlocks with one of the second engaging blocks, and the pressing portion is pressed against the stop portion, thereby fixing the second rail and the drawer frame member to each other.

8. The quick-release mechanism for drawer slide parts of claim 7, wherein each said first engaging block has a front end provided with a first inclined surface, each said second engaging block has a front end provided with a second inclined surface, and the second inclined surface of the one of the second engaging blocks moves past the first inclined surface of the one of the first engaging blocks in order for the one of the first engaging blocks to interlock with the one of the second engaging blocks.

9. The quick-release mechanism for drawer slide parts of claim 7, wherein the elastic arm has an operating member operable to disengage the one of the first engaging blocks from the one of the second engaging blocks.

* * * * *